US007735981B2

(12) United States Patent
Vaeth et al.

(10) Patent No.: US 7,735,981 B2
(45) Date of Patent: Jun. 15, 2010

(54) CONTINUOUS INK-JET PRINTING WITH JET STRAIGHTNESS CORRECTION

(75) Inventors: Kathleen M. Vaeth, Rochester, NY (US); Ali G. Lopez, Pittsford, NY (US); Edward P. Furlani, Lancaster, NY (US)

(73) Assignee: Eastman Kodak Company, Rochester, NY (US)

( * ) Notice: Subject to any disclaimer, the term of this patent is extended or adjusted under 35 U.S.C. 154(b) by 353 days.

(21) Appl. No.: 11/831,156

(22) Filed: Jul. 31, 2007

(65) Prior Publication Data

US 2009/0033723 A1 Feb. 5, 2009

(51) Int. Cl.
*B41J 2/09* (2006.01)

(52) U.S. Cl. ..... 347/77

(58) Field of Classification Search ..... 347/77, 347/73–76, 78–83

See application file for complete search history.

(56) References Cited

U.S. PATENT DOCUMENTS

| | | | |
|---|---|---|---|
| 1,941,001 | A | 12/1933 | Hansell |
| 3,373,437 | A | 3/1968 | Sweet et al. |
| 3,416,153 | A | 12/1968 | Hertz et al. |
| 3,709,432 | A | 1/1973 | Robertson |
| 3,878,519 | A | 4/1975 | Eaton |
| 4,346,387 | A | 8/1982 | Hertz |
| 6,079,821 | A | 6/2000 | Chwalek et al. |
| 6,203,145 | B1 | 3/2001 | Jeanmaire et al. |
| 6,517,197 | B2 | 2/2003 | Hawkins et al. |
| 2002/0085073 | A1 | 7/2002 | Chwalek et al. |

FOREIGN PATENT DOCUMENTS

| | | |
|---|---|---|
| EP | 0 911 166 | 4/1999 |
| EP | 1 219 426 | 7/2002 |

*Primary Examiner*—K. Feggins
(74) *Attorney, Agent, or Firm*—William R. Zimmerli

(57) ABSTRACT

A printhead includes a droplet-forming heater operable in a first state to form droplets from a fluid stream having a first volume traveling along a path direction and in a second state to form droplets from the fluid stream having a second volume traveling along the path direction. A droplet deflector system is positioned relative to the droplet-forming heater, which applies a force to the droplets traveling along the path direction, whereby the droplets having the first volume diverge from the path direction by a greater extent than do the droplets having the second volume. A droplet-steering heater is adapted to selectively asymmetrically apply heat to the stream such that the path direction is changed.

20 Claims, 9 Drawing Sheets

CONTINUOUS INK-JET PRINTING WITH JET STRAIGHTNESS CORRECTION

FIELD OF THE INVENTION

This invention relates generally to the field of digitally controlled printing devices, and in particular to continuous ink jet printers in which a liquid ink stream breaks into droplets, some of which are selectively deflected. Either the deflected droplets or the non-deflected droplets can be printed on a print medium with the droplets having corrected print locations.

BACKGROUND OF THE INVENTION

Traditionally, digitally controlled color printing capability is accomplished by one of two technologies. The first technology, commonly referred to as "drop-on-demand" ink jet printing, provides ink droplets for impact upon a recording surface using a pressurization actuator (thermal, piezoelectric, etc.). Selective activation of the actuator causes the formation and ejection of a flying ink droplet that crosses the space between the printhead and the print media and strikes the print media. The second technology, commonly referred to as "continuous stream" or "continuous" ink jet printing, uses a pressurized ink source that produces a continuous stream of ink droplets. Conventional continuous ink jet printers utilize electrostatic charging devices and deflector plates. Examples of conventional continuous ink jet printers include U.S. Pat. No. 1,941,001 issued to Hansell, on Dec. 26, 1933; U.S. Pat. No. 3,373,437 issued to Sweet et al., on Mar. 12, 1968; U.S. Pat. No. 3,416,153 issued to Hertz et al., on Dec. 10, 1968; U.S. Pat. No. 3,878,519 issued to Eaton, on Apr. 15, 1975; and U.S. Pat. No. 4,346,387 issued to Hertz, on Aug. 24, 1982.

U.S. Pat. No. 3,709,432, which issued to Robertson on Jan. 9, 1973, discloses stimulation of an ink filament to cause the ink to break up into uniformly spaced droplets. Before they break up into droplets, the lengths of the filaments are regulated by controlling the stimulation energy supplied to transducers, with high amplitude stimulation resulting in short filaments and low amplitudes resulting in long filaments. A flow of air across their paths affects the trajectories of the filaments before they break up into droplets. By controlling the lengths of the filaments, the trajectories of the ink droplets can be controlled, or switched from one path to another. As such, some ink droplets may be directed into a catcher while allowing other ink droplets to be applied to a receiver.

U.S. Pat. No. 6,079,821, which issued to Chwalek et al. on Jun. 27, 2000, discloses a continuous ink jet printer. A printhead includes a plurality of nozzles, each of which uses actuation of a single asymmetric heater to both create individual ink droplets from a filament of working fluid and deflect those ink droplets. Printed ink droplets flow along a printed ink droplet path ultimately striking a receiver, while non-printed ink droplets flow along a non-printed ink droplet path ultimately striking a catcher surface. Non-printed ink droplets are recycled or disposed of through an ink removal channel formed in the catcher.

The paths of drops ejected from a row of equally spaced nozzles should be parallel. Continuous inkjet printheads often require fine adjustments in jet direction and drop placement to counteract flight path errors due, for example by manufacturing defects in the printhead, differences in the resistances of the drop-formation heaters, particles and other debris near the nozzle bores, air turbulence and splay, stitching defects, etc. It has been suggested that such adjustments can be effected by segmenting the drop formation heater in much the way suggested by Chwalek et al. in above-mentioned U.S. Pat. No. 6,079,821. Different power levels can then be applied to the heater segments in order to steer the jet in a desired direction to compensate for flight path errors. However, use of the drop formation heater to also adjust jet direction and drop placement convolutes the two processes, potentially requiring trade-offs in the optimization of drop formation and drop placement.

U.S. Pat. No. 6,517,197, which issued to Hawkins et al. on Feb. 11, 2003, recognized that, while the ink droplet-forming mechanism and the ink droplet-steering mechanism may be the same mechanism, it is also possible to make the droplet-forming mechanism and the droplet-steering mechanism separate distinct mechanisms. The examples provided by Hawkins et al. included a piezoelectric actuator droplet-forming mechanism with a segmented heater droplet-steering mechanism. While such a system overcomes the need for trade-offs in the optimization of drop formation and drop placement that would exist in the Chwalek et al. device, the use of a segmented heater droplet-steering mechanism would add a little extra energy to a jet. This would undesirably increase the velocity of corrected jets and cause the corrected jet to be out of sync with the non-corrected jets. It is feature of the present invention to compensate for the additional energy added by the segmented heater by providing a heater as the droplet-forming mechanism and to adjust the total amount of energy applied to corrected jets so as to keep the velocity of the corrected jets the same as the velocity of the non-corrected jets by reducing the energy from the droplet-forming mechanism by an amount substantially equal to the additional energy added by the segmented heater.

It is an object of the present invention is to simplify construction of a continuous ink jet printhead and printer having improved placement accuracy of individual ink drops in order to render images of high quality.

It is another object of the present invention to provide a continuous ink jet printhead and printer capable of rendering high-resolution images with reduced image artifacts using large volumes of ink.

It is yet another object of the present invention is to improve the reliability of a continuous ink jet printhead.

It is still another object of the present invention to simplify construction and operation of a continuous ink jet printer suitable for printing high quality images having reduced artifacts due to systematic errors of drop placement.

SUMMARY OF THE INVENTION

According to a feature of the present invention, a continuous ink jet printer in which a continuous stream of ink is emitted from a nozzle bore includes an ink delivery channel and a source of pressurized ink to establish a continuous stream of ink. A droplet-forming heater causes the stream to break up into a plurality of droplets. Actuation of a droplet-steering heater, having at least one selectively actuated section associated with less than the entire perimeter of the nozzle bore, produces an asymmetric application of heat to the stream to control the direction of the stream. The droplet-steering heater is preferably formed of a plurality of heater sections that, in the aggregate, substantially surround the nozzle bore so that selective actuation of the heater sections steers the stream in any of a plurality of directions away from the actuated heated sections.

According to another feature of the present invention, a printhead includes a droplet-forming heater operable in a first state to form droplets from a fluid stream having a first volume traveling along a path direction and in a second state to form droplets from the fluid stream having a second volume traveling along the path direction. A droplet deflector system is positioned relative to the droplet-forming heater, which applies a force to the droplets traveling along the path direction, whereby the droplets having the first volume diverge from the path direction by a greater extent than do the droplets having the second volume. A droplet-steering heater is adapted to selectively asymmetrically apply heat to the stream such that the path direction is changed.

According to still another feature of the present invention, a method of correcting droplet placement error in a printhead includes the steps of forming droplets from fluid ejected through a first nozzle using a first, droplet-forming heater, the droplets traveling in an ejection direction; determining when the ejection direction is other than in a desired direction; and using a second, droplet-steering heater to change the ejection direction of the droplets to the desired direction by asymmetrically applying heat to the fluid.

According to yet another feature of the present invention, a method of printing an image includes the steps of forming, by means of a droplet-forming heater, droplets having a first volume traveling along a path direction and droplets having a second volume traveling along the path direction; applying a force to the droplets traveling along the path direction such that the droplets having the first volume diverge from the path direction by a greater extent than do the droplets having the second volume; and using a droplet-steering heater to selectively asymmetrically apply heat to the stream such that the path direction is changed.

DETAILED DESCRIPTION OF THE INVENTION

The present description will be directed in particular to elements forming part of, or cooperating more directly with, apparatus in accordance with the present invention. It is to be understood that elements not specifically shown or described may take various forms well known to those skilled in the art.

Figure 1:
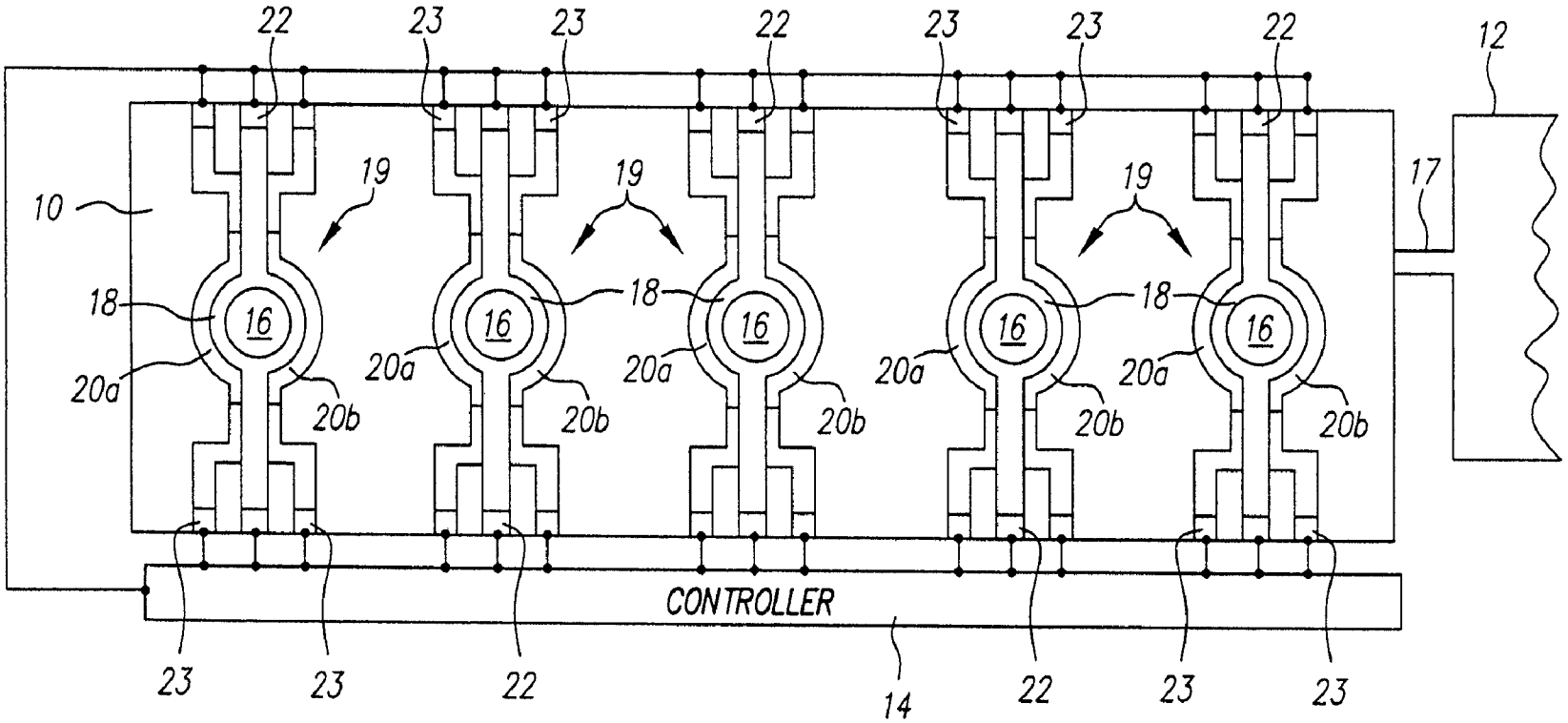
FIG. 1 is a schematic plan view of a printhead made in accordance with a preferred embodiment of the present invention.

Referring to FIG. 1, an integrated printhead 10 is associated with at least one ink supply 12 and a controller 14. Controller 14 can be of any type, including a microprocessor-based device having a predetermined program, etc. Although integrated printhead 10 is illustrated schematically and not to scale for the sake of clarity, one of ordinary skill in the art will be able to readily determine the specific size and interconnections of the elements of the preferred.

At least one nozzle bore 16 is formed on printhead 10. Nozzle bore 16 is in fluid communication with ink supply 12 through an ink passage 17 also formed in or connected to printhead 10. Black and white or single color printing may be accomplished using a single ink supply 12 and one set of nozzle bores 16. Printhead 10 may incorporate additional ink supplies and corresponding nozzle bore sets in order to provide color printing using three or more primary ink colors.

Integrated printhead 10 can be manufactured using known techniques, such as CMOS and MEMS techniques. There can be any number of nozzle bores 16 and the distance between the nozzle bores can be adjusted in accordance with the particular application to avoid ink coalescence, and deliver the desired resolution. Integrated printhead 10 can be formed using a silicon substrate, etc. Also, integrated printhead 10 can be of any size and components thereof can have various relative dimensions.

Figure 4:
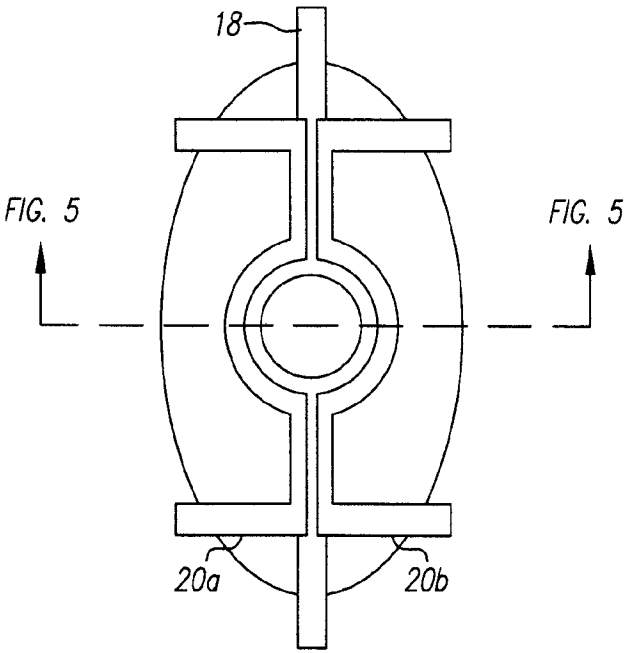
FIG. 4 is a top plan view of the assembled ink droplet-forming heater of FIG. 2 and the ink droplet-steering heater of FIG. 3.
Figure 3:
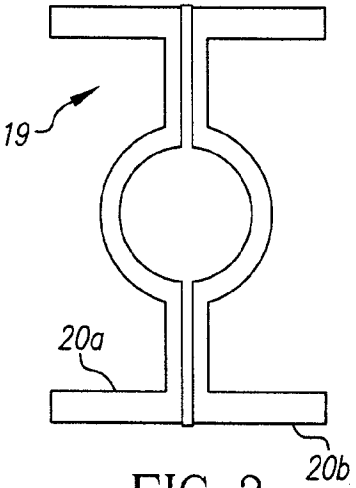
FIG. 3 is a schematic plan view of an ink droplet-steering heater used in the printhead of FIG. 1.
Figure 2:
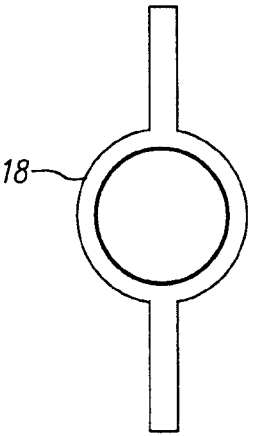
FIG. 2 is a schematic plan view of an ink droplet-forming heater used in the printhead of FIG. 1.
Figure 5:
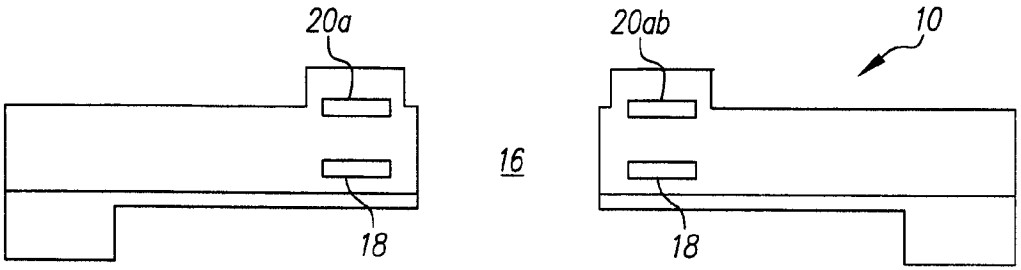
FIG. 5 is a side sectional view of the printhead of FIG. 1 taken along line 5-5 of FIG. 4.
Figure 6:
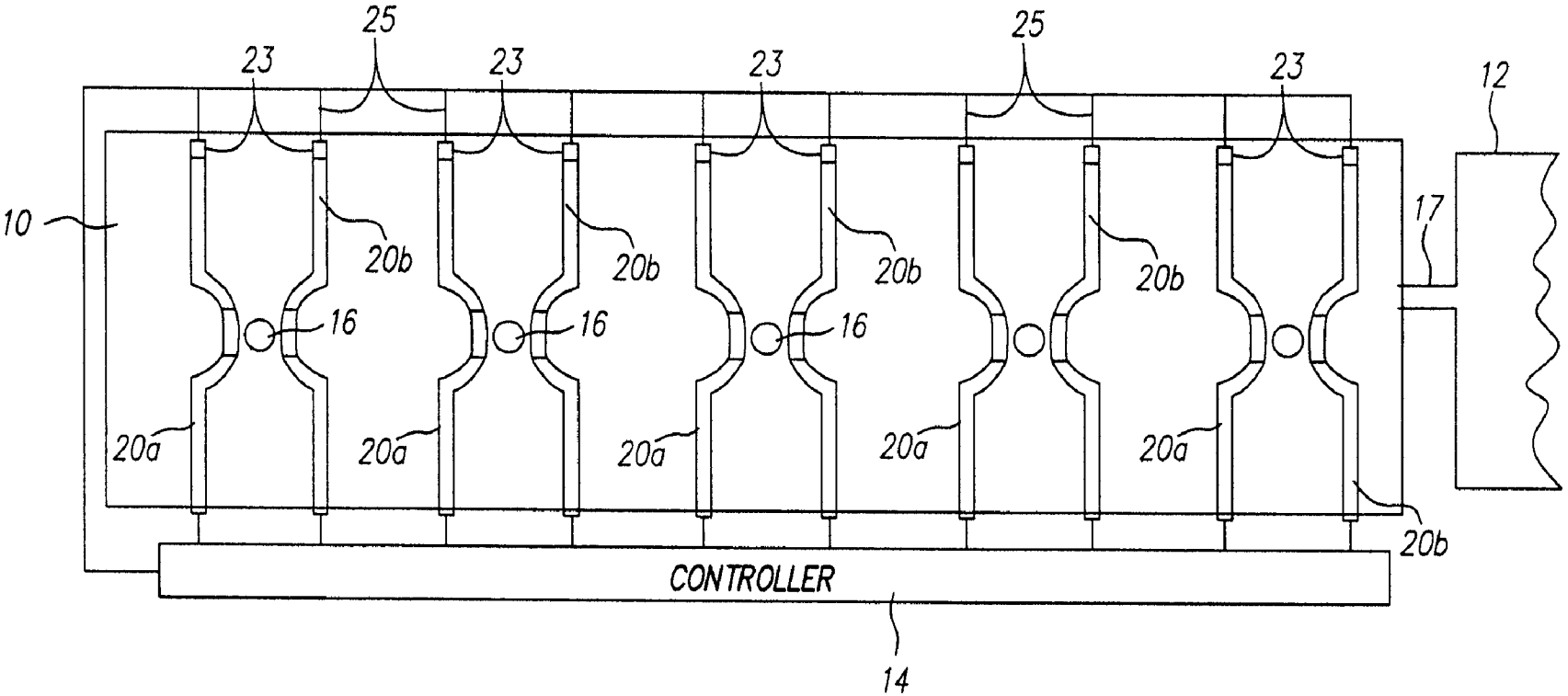
FIG. 6 is a schematic plan view of a printhead made in accordance with another preferred embodiment of the present invention.

An ink droplet-forming heater 18 and an ink droplet-steering split heater 19 are formed or positioned on printhead 10 around a corresponding nozzle bore 16. FIG. 2 is a detailed view of droplet-forming heater 18, FIG. 3 is a detailed view of droplet-steering heater 19, and FIG. 4 is an assembled view of heaters 18 and 19. FIG. 5 is a sectional view taken through printhead 10 along section line 5-5 of FIG. 4. Ink droplet-steering heater 19 comprises a first side 20*a* and a second side 20*b* formed or positioned on printhead 10 around a corresponding nozzle bore 16. Although droplet-steering heater 19 may be disposed radially away from an edge of corresponding nozzle bore 16, the split heater is preferably disposed close to the corresponding nozzle in a concentric manner. In a preferred embodiment, the split heater is formed in a substantially circular or ring shape. In an alternative preferred embodiment, shown in FIG. 6, droplet-steering heater 19 has a rectangular first side 20*a* and rectangular second side 20*b*. Droplet-steering heater 19 may be formed in a partial segmented ring, square, etc. Droplet-forming heater 18 and droplet-steering heater 19 are made of an electric resistive material, for example a thin film material such as titanium nitride or polysilicon, and are connected to electrical contact pads 22 and 23, respectively, via conductors 25. The heaters may be deposited by well-known techniques of thin film deposition and patterning, such as evaporation, sputtering, chemical vapor deposition, photolithography, and etching.

Conductors 25 and their associated electrical contact pads 22 and 23 may be at least partially formed or positioned on printhead 10 and provide an electrical connection between controller 14 and the heaters. Alternatively, the electrical connection between controller 14 and the heaters may be accomplished in any well-known manner. Droplet-forming heaters 18, droplet-steering heaters 19, electrical contact pads 22 and 23 and conductors 25 can be formed and patterned through vapor deposition and lithography techniques, etc. Droplet-forming heaters 18 and droplet-steering heaters 19 can include heating elements of any shape and type, such as resistive heaters, radiation heaters, convection heaters, chemical reaction heaters (endothermic or exothermic), etc.

Figure 7:
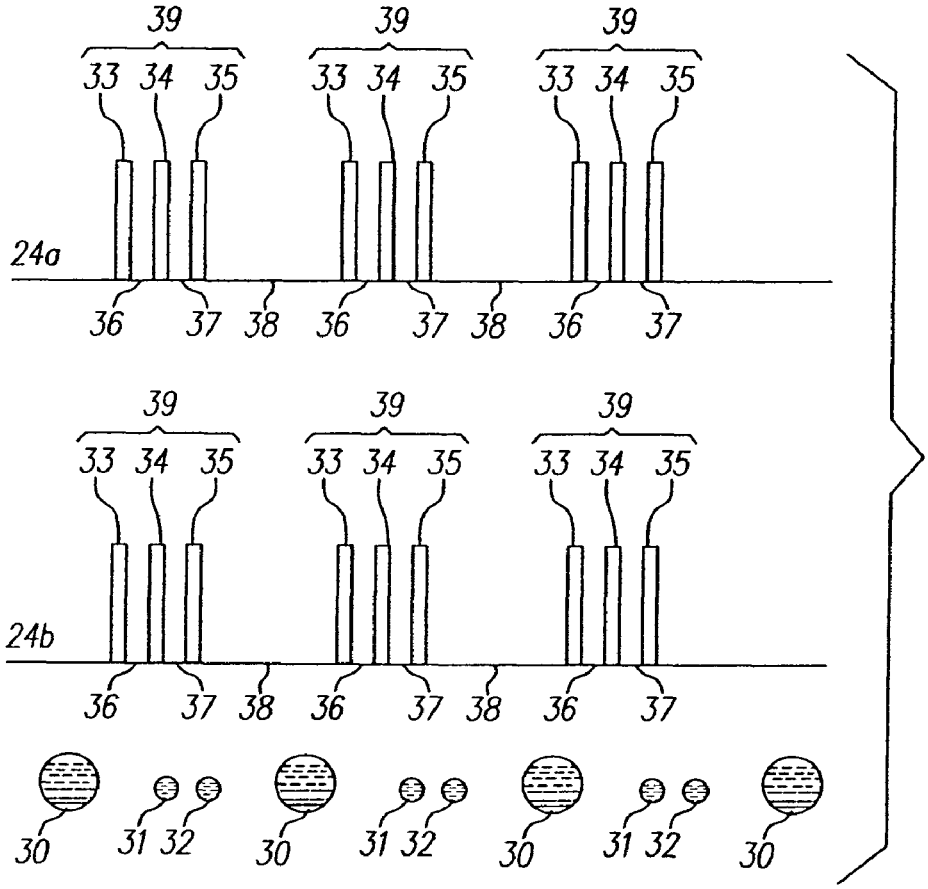
FIG. 7 is a diagram illustrating a frequency control of a droplet-forming heater and the resulting ink droplets.

An example of the electrical activation waveform provided by controller 14 to droplet-forming heater 18 is shown generally in FIG. 7 as a function of time (horizontal axis). Individual ink droplets 30, 31, and 32, resulting from the ejection of ink from nozzle 16 and actuation of droplet-forming heater 18, are shown schematically at the bottom of FIG. 7. A high frequency of activation of heater 18 results in small volume droplets 31, 32, while a low frequency of activation of heater 18 results in large volume droplets 30. The drops are spaced in time as they are ejected from nozzle 16 according to the same time axes of the electrical waveforms.

In a preferred implementation, which allows for the printing of multiple droplets per image pixel, a time 39 associated with printing of an image pixel includes time sub-intervals reserved for the creation of small printing droplets 31, 32 plus time sub-intervals for creating one larger non-printing droplet 30. In FIG. 7, only time for the creation of two small droplets 31, 32 is shown for simplicity of illustration, however, it should be understood that the reservation of more time for a larger number of small droplets is clearly within the scope of this invention.

When printing each image pixel, large droplet 30 is created through the activation of droplet-forming heater 18 with electrical pulse time 33, typically from 0.1 microseconds to 10 microseconds in duration, and more preferentially 0.5 to 1.5 microseconds. The additional (optional) activation of droplet-forming heater 18, after delay time 36, with an electrical pulse 34 is conducted in accordance with image data wherein at least one small droplet is required. When image data requires another small droplet be created, droplet-forming heater 18 is again activated after delay 37, with a pulse 35. In this example, small droplets 31, 32 are printed while large droplet 30 is guttered.

Heater activation electrical pulse times 33, 34, and 35 are substantially similar, as are delay times 36 and 37. Delay times 36 and 37 are typically 1 microsecond to 100 microseconds, and more preferentially, from 3 microseconds to 6 microseconds. Delay time 38 is the remaining time after the maximum number of small droplets have been formed and the start of electrical pulse time 33, concomitant with the beginning of the next image pixel with each image pixel time being shown generally at 39. The sum of droplet-forming heater 18 electrical pulse time 33 and delay time 38 is chosen to be significantly larger than the sum of a heater activation time 34 or 35 and delay time 36 or 37, so that the volume ratio of large droplets to small droplets is preferentially a factor of four or greater. It is apparent that droplet-forming heater 18 activation may be controlled independently based on the ink color required and ejected through corresponding nozzle 16, movement of printhead 10 relative to a print medium, and an image to be printed. The absolute volume of the small droplets 31 and 32 and the large droplets 30 may be adjusted based upon specific printing requirements such as ink and media type or image format and size. As such, reference below to large volume non-printed droplets 30 and small volume printed droplets 31 and 32 is relative in context for example purposes only and should not be interpreted as being limiting in any manner.

Figure 8:
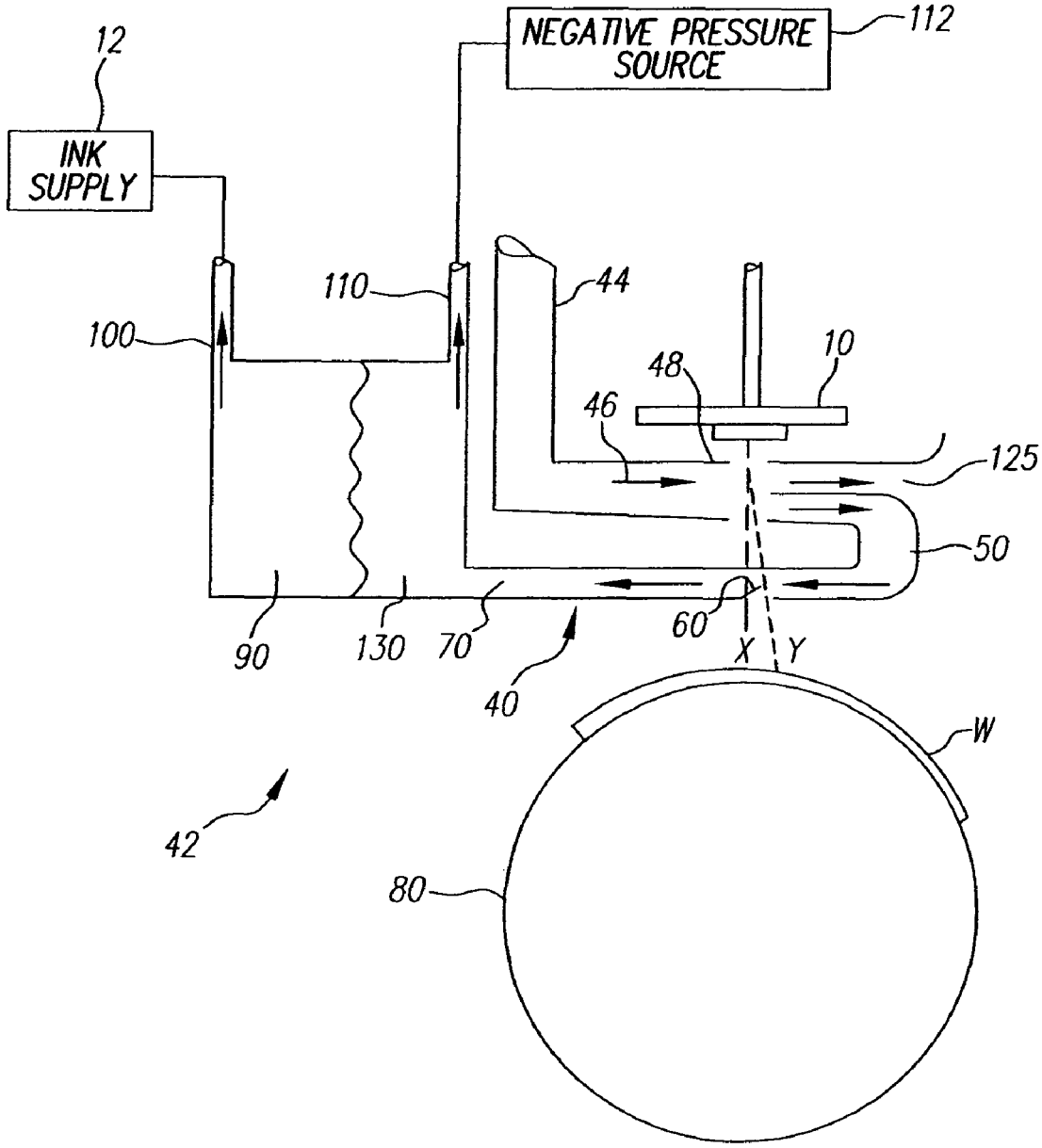
FIG. 8 is a schematic view of an ink jet printer made in accordance with the preferred embodiment of the present invention.

FIG. 8 illustrates one embodiment of a printing apparatus 42 (typically, an ink jet printer or printhead) wherein large volume ink droplets 30 and small volume ink droplets 31 and 32 are ejected from integrated printhead 10 substantially along a path X in a stream. A droplet deflector system 40 applies a force (shown generally at 46) to ink droplets 30, 31, and 32 as ink droplets 30, 31, and 32 travel along path X. Force 46 interacts with ink droplets 30, 31, and 32 along path X, causing the ink droplets 31 and 32 to alter course. As ink droplets 30 have different volumes and masses from ink droplets 31 and 32, force 46 causes small droplets 31 and 32 to separate from large droplets 30 with small droplets 31 and 32 diverging from path X along small droplet or printed path Y. While large droplets 30 can be slightly affected by force 46, large droplets 30 remain traveling substantially along path X.

Droplet deflector system 40 can include a gas source that provides force 46. Typically, force 46 is positioned at an angle with respect to the stream of ink droplets operable to selectively deflect ink droplets depending on ink droplet volume. Ink droplets having a smaller volume are deflected more than ink droplets having a larger volume.

Droplet deflector system 40 facilitates laminar flow of gas through a plenum 44. An end 48 of the droplet deflector system 40 is positioned proximate path X. An ink recovery conduit 70 is disposed opposite a recirculation plenum 50 of droplet deflector system 40 and promotes laminar gas flow while protecting the droplet stream moving along path X from air external air disturbances. Ink recovery conduit 70 contains a ink guttering structure 60 whose purpose is to intercept the path of large droplets 30, while allowing small ink droplets 31, 32, traveling along small droplet path Y, to continue on to a receiver W carried by a print drum 80.

In a preferred implementation, the gas pressure in droplet deflector system 40 and in ink recovery conduit 70 are adjusted in combination with the design of ink recovery conduit 70 and recirculation plenum 50 so that the gas pressure in the print head assembly near ink guttering structure 60 is positive with respect to the ambient air pressure near print drum 80. Environmental dust and paper fibers are thusly discouraged from approaching and adhering to ink guttering structure 60 and are additionally excluded from entering ink recovery conduit 70.

In operation, a recording media W is transported in a direction transverse to path X by print drum 80 in a known manner. Transport of recording media W is coordinated with movement of integrated printhead 10. This can be accomplished using controller 16 in a known manner.

Ink recovery conduit 70 communicates with an ink recovery reservoir 90 to facilitate recovery of non-printed ink droplets by an ink return line 100 for subsequent reuse. Ink recovery reservoir 90 can include an open-cell sponge or foam 130, which prevents ink sloshing in applications where the integrated printhead 10 is rapidly scanned. A vacuum conduit 110, coupled to a negative pressure source 112 can communicate with ink recovery reservoir 90 to create a negative pressure in ink recovery conduit 70 improving ink droplet separation and ink droplet removal. The gas flow rate in ink recovery conduit 70, however, is chosen so as to not significantly perturb small droplet path Y. Additionally, gas recirculation plenum 50 diverts a small fraction of the gas flow crossing ink droplet path X to provide a source for the gas that is drawn into ink recovery conduit 70.

Droplet deflector system 40 can be of any type and can include any number of appropriate plenums, conduits, blowers, fans, etc. Additionally, droplet deflector system 40 can include a positive pressure source, a negative pressure source, or both, and can include any elements for creating a pressure gradient or gas flow. Ink recovery conduit 70 can be of any configuration for catching deflected droplets and can be ventilated if necessary.

In the illustrated embodiment, small droplets form printed droplets that impinge on the receiver while large droplets are collected by an ink guttering structure. However, large droplets can form the printed droplets while small droplets are collected by the ink guttering structure. This can be accomplished by positioning the ink guttering structure, in any known manner, such that the ink guttering structure collects the small droplets. Printing in this manner provides printed droplets having varying sizes and volumes.

Large volume droplets 30 and small volume droplets 31 and 32 can be of any appropriate relative size. However, the droplet size is primarily determined by ink flow rate through nozzle bore 16 and the frequency at which droplet-forming heater 18 is cycled. The flow rate is primarily determined by the geometric properties of nozzle bore 19 such as nozzle diameter and length, pressure applied to the ink, and the fluidic properties of the ink such as ink viscosity, density, and surface tension. As such, typical ink droplet sizes may range from, but are not limited to, 1 to 10,000 Pico liters.

Although a wide range of droplet sizes are possible, at typical ink flow rates, for a 10 micron diameter nozzle, large volume droplets 30 can be formed by cycling heaters at a frequency of 50 kHz producing droplets of 20 Pico liter in volume and small volume droplets 31 and 32 can be formed by cycling heaters at a frequency of 200 kHz producing droplets that are 5 Pico liter in volume. These droplets typically travel at an initial velocity of 10 m/s to 20 m/s. Even with the above droplet velocity and sizes, a wide range of separation distances S between large volume and small volume droplets is possible depending on the physical properties of the gas used, the velocity of the gas and the interaction distance L, as stated previously. For example, when using air as the gas, typical air velocities may range from, but are not limited to 100 to 1000 cm/s while interaction distances L may range from, but are not limited to, 0.1 to 10 mm.

Receiver W can be of any type and in any form. For example, the receiver can be in the form of a web or a sheet. Additionally, receiver W can be composed from a wide variety of materials including paper, vinyl, cloth, other large fibrous materials, etc. Any mechanism can be used for moving the printhead relative to the receiver, such as a conventional raster scan mechanism, etc.

In the embodiments discussed above, controller 14 is provided to control the trajectory of ink drops 30, 31, 32 ejected from nozzle bore 16 in the slow scan direction which controls the placement of ink drops on a receiver in the slow scan. As such, a simplified printhead and printer having reduced image artifacts due to ink drop misalignment in the slow scan direction is provided. It is also contemplated that if the printed ink drop position, in the slow scan direction, differs from the desired printed position, ink drop misplacement is corrected by controlling or modifying the electrical activation waveforms provided to integrated printhead 10. In order to accomplish this, the extent of ink drop misplacement in the slow scan direction of ink drops ejected from one or more printhead nozzle bores is ascertained. This can be accomplished using any device and/or method known in the art. In the event that correction is needed, voltage waveforms from controller 14 provide electrical activation waveforms so as to correct misplacement. To this extent, it is understood that the slow scan direction is generally perpendicular to the direction of motion of the recording medium and integrated printhead 10 during a fast scan printing of one or more image swaths.

As is well known in the art of inkjet printing, misplacement errors may be determined by observing, for example with a digital imager, etc., the placement of ink drops intended to be printed at particular locations. Then, using a look-up table to determine the appropriate electrical activation waveforms to be provided to integrated printed 10. Alternatively, determination procedures, for example, the procedure of using an optical sensor including a quad photodiode detector whose outputs are indicative of the positions of vertical test lines; projecting light upon a flying ink drop and detecting misalignment by the amount of light reflected; using an optical technique for detecting droplet position; and using a piezoelectric detector for drop position determination, can be used. It is contemplated that determining the extent of ink drop misplacement can be made repeatedly, correcting as necessary, thereby reducing subsequent errors in ink drop placement during each printing iteration as look-up tables are refined.

While the drop volumes, spacings, velocities etc. are provided by droplet-forming heater 18, droplet steering is controlled by heater 19. Droplets ejected using different electrical activation of first and second sides 20*a* and 20*b*, respectively, differ in their printed positions in a direction substantially parallel to the direction defined by the row of nozzle bores on integrated printhead 10. By controlling the electrical activation waveforms, for example by using controller 14, the printed positions of droplets can be controlled. More generally stated, in accordance with the present invention, the drops provided by integrated printhead 10 can be printed in different positions in a direction parallel to a steering direction of droplet-steering heater 19. These positions depend on the electrical activation waveforms.

The ability to print droplets in different positions comes from the action of droplet-steering heater 19, which causes angulation of the droplet path or trajectory along the steering direction. Thereby, in conjunction with controller 14, the paths of drops ejected from nozzle bores 16 can be controlled. For example, the paths of drops ejected from nozzle bores 16 can be controlled to be parallel when viewed along the fast scan direction.

The droplet-steering mechanism of FIGS. 1 and 2 steers the jetted drops in a left and right direction as viewed in FIGS. 1 and 2. Hence the positions of droplets on the recording medium are controlled in a line parallel to the row of nozzles, that is, in the slow scan direction. The steering direction of droplet-steering heater 19 is perpendicular to its axis of symmetry, and thus the steering direction would change if, for example, droplet-steering heater 19 were rotated in FIG. 1. More generally stated, the steering direction of droplets and thus the direction in which droplets can be controllable positioned by the steering mechanism on the receiver is parallel to a line between corresponding sides 20*a* and 20*b* of droplet-steering heater 19.

Figure 9:
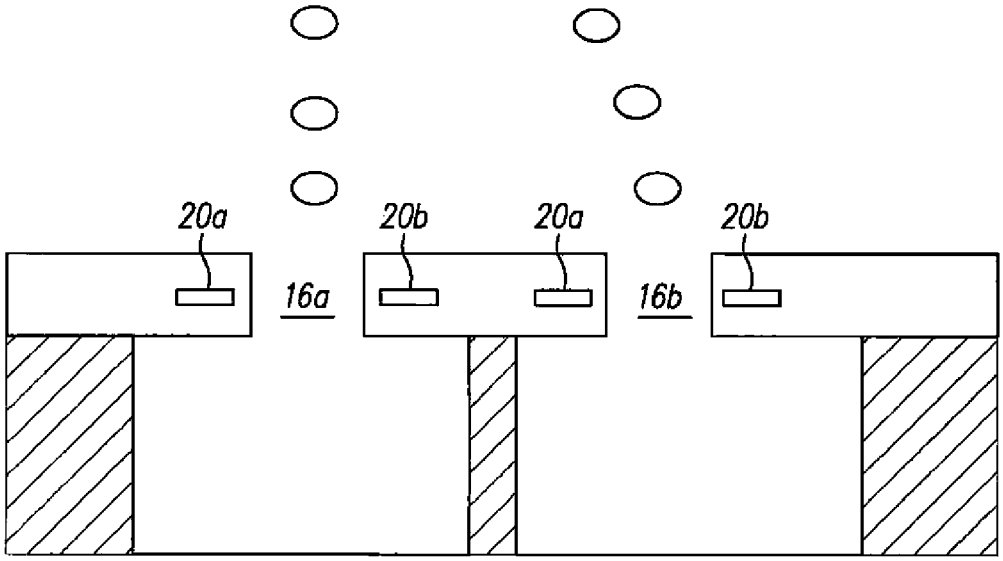
FIG. 9 is a side sectional view of a printhead wherein droplets emitted with a crooked trajectory have not been corrected.
Figure 10:
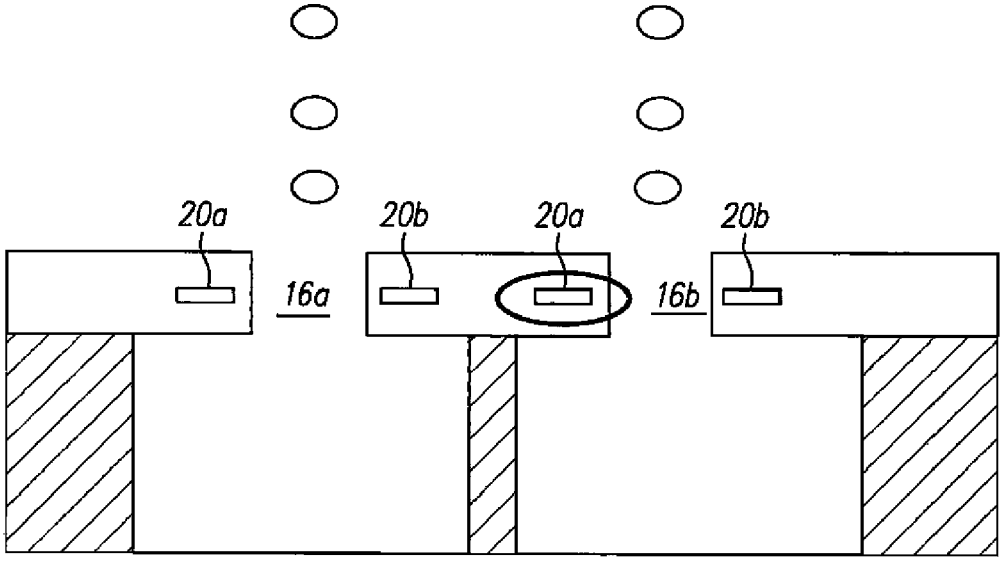
FIG. 10 is a side sectional view of a printhead of FIG. 9 wherein droplets, which would have been emitted with a crooked trajectory, have been corrected.

FIGS. 9 and 10 illustrate a pair of nozzle bores on a printhead. Ink droplet-forming heaters have been omitted from these schematic drawings for clarity. In FIG. 9, droplet-steering heaters 19 have not been activated. The ink droplets from left nozzle bore 16*a* follow a vertical trajectory, but the trajectory of the ink droplets from right nozzle bore 16*b* is crooked. Such crooked trajectory may be due to misalignment of the bore and ink channel. If the angle of deviation is severe enough and not corrected, the crooked trajectory will cause image artifacts. It will be understood by those skilled in the art that the present invention is not limited to the correction of crooked trajectories, but may be applied to purposely change the direction of straight trajectory jets to improve drop placement accuracy, to mask streak artifacts, to dither the jets, and to hide stitching artifacts.

If drops from one or more nozzle bores 16 are found to be systematically misaligned due to a nozzle defect, controller 14 can control the electrical activation waveforms applied to either of the first and second sides 20*a* and 20*b* of the associated droplet-steering heater 19 of the misaligned nozzles so that for each misaligned nozzle, the drop trajectory is caused to be the desired trajectory and the misalignment is corrected.

Correction of misalignment is illustrated in FIG. 10, wherein an electrical activation waveform has been applied to first side 20*a* of droplet-steering heater 19 to restore a proper trajectory of the ejected droplets. The misalignment of nozzle 16*b* has been corrected by altering the electrical activation waveform applied to the first side 20*a* of the split droplet-steering heater 19.

It should be understood that the energy applied to the droplet by steering heater 19 to restore a proper trajectory of the ejected droplet, if not compensated for, will increase the velocity of the drop formed by droplet-forming heater 18 and result in a misplaced drop on the receiver. Because the droplet-forming mechanism and droplet-steering mechanism are both heaters and are separate one from the other, the extra energy added to a droplet by droplet-steering heater 19 can easily be compensated for by programming controller 14 to reduce the energy supplied by droplet-forming heater 18.

Figure 11:
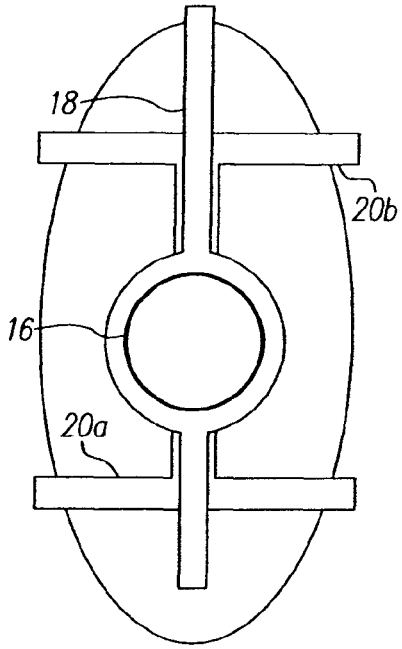
FIG. 11 is a top plan view of an alternative embodiment of the assembled ink droplet-forming heater of FIG. 2 and the ink droplet-steering heater of FIG. 3.
Figure 12:
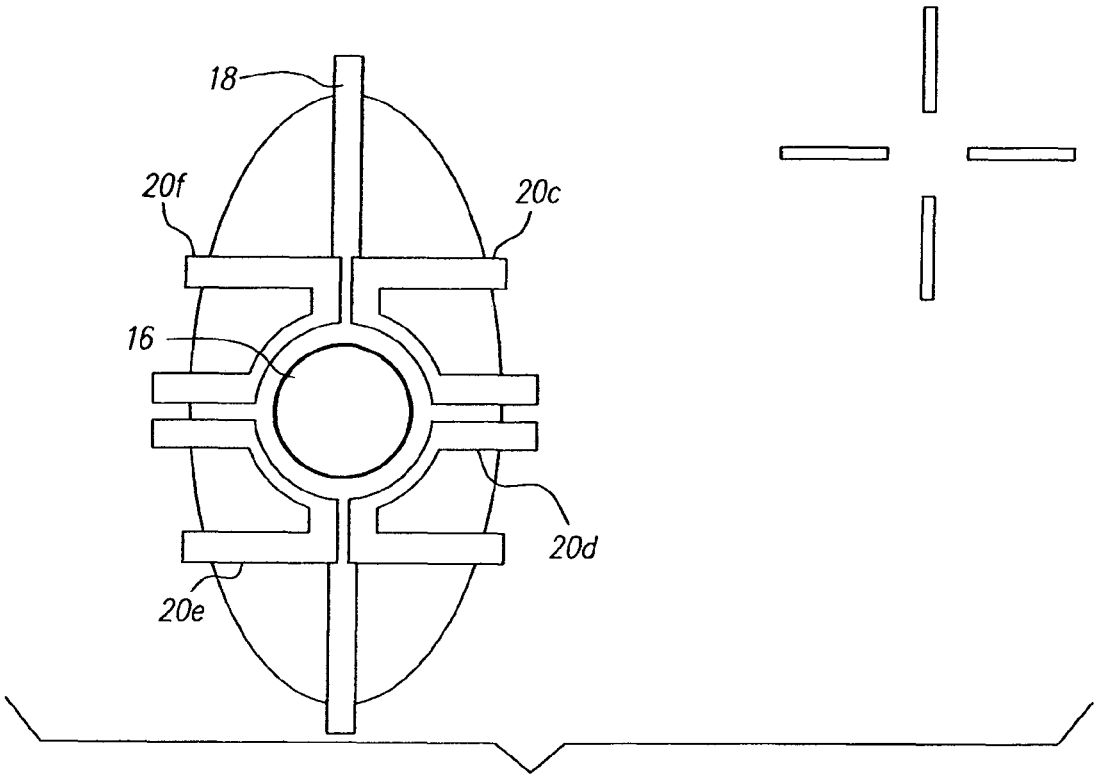
FIG. 12 is a top plan view of an alternative embodiment of the assembled ink droplet-forming heater of FIG. 2 and an alternative embodiment of the ink droplet-steering heater of FIG. 3.
Figure 13:
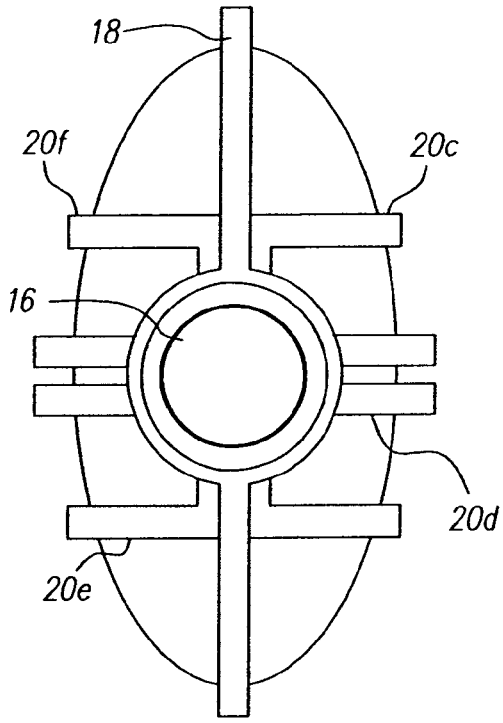
FIG. 13 the ink droplet-forming heater the ink droplet-steering heater of FIG. 12 with the stacking order of the heaters reversed from that of FIG. 12.
Figure 14:
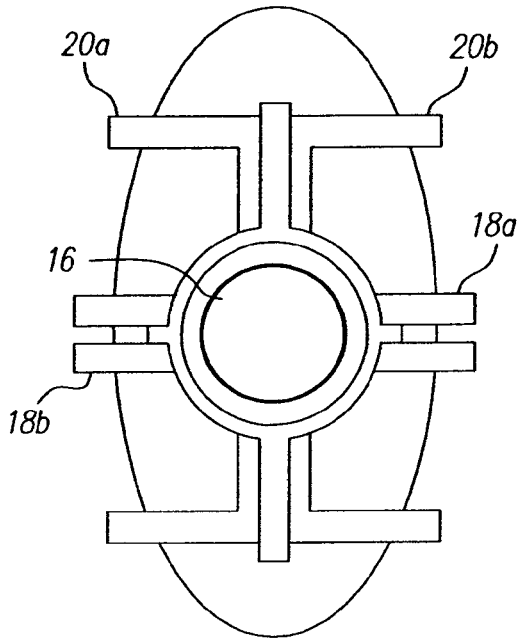
FIG. 14 shows that droplet-forming heater can also be split for controlling the trajectory of the droplets in a direction normal to the control offered by the droplet-steering heater.

While the embodiment of the invention illustrated in FIGS. 2-4 have droplet-forming heater 18 below droplet-steering heater 19 in the orientation of the drawings, an embodiment illustrated in FIG. 11 reverses the order of the heaters. In another embodiment illustrated in FIG. 12, droplet-steering heater 19 is split into four quadrants 20*c*, 20*d*, 20*e* and 20*f* for additional control of the droplet trajectory. FIG. 13 shows this feature with the stacking order of the heaters reversed from that of FIG. 12. FIG. 14 shows that droplet-forming heater 18 can also be split into two segments 18*a* and 18*b* for controlling the trajectory of the droplets in a direction normal to the control offered by droplet-steering heater 19. Of course any amount of angular rotation of the split heaters can be used for trajectory control.

Figure 15:
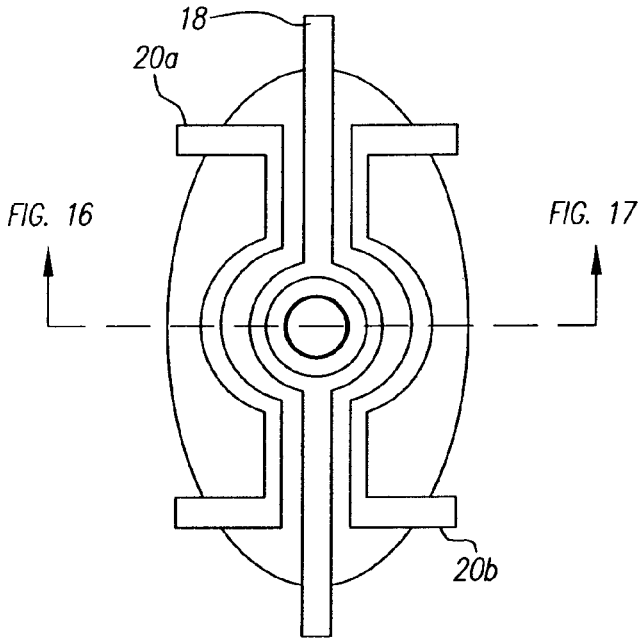
FIG. 15 shows the two heaters one outside of the other and lying in the same plane.
Figure 16:
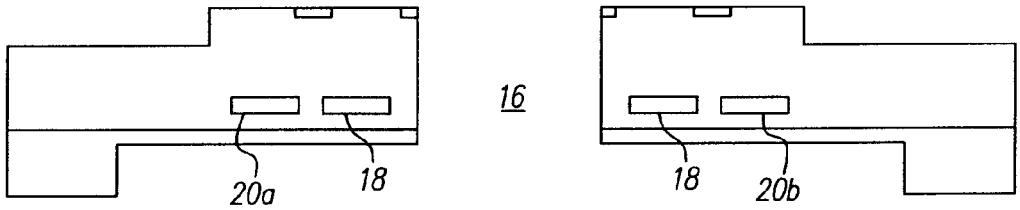
FIGS. 16 and 17 are alternative side sectional views taken along line 16-17 of FIG. 15.
Figure 17:
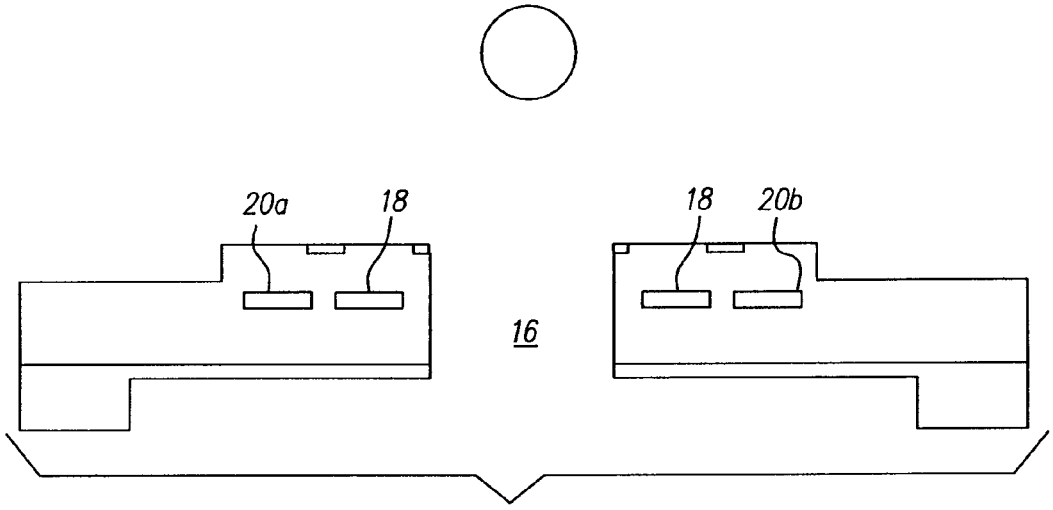

The embodiments of the present invention described above provide for droplet-forming heater 18 and droplet-steering heater 19 to be stacked one above the other. This is not a requirement, and other orientations are contemplated within the scope of the invention. For example, FIG. 15 shows the two heaters one outside of the other and lying in the same plane, as indicated in the alternative views of FIGS. 16 and 17.

While the foregoing description includes many details and specificities, it is to be understood that these have been included for purposes of explanation only, and are not to be interpreted as limitations of the present invention. Many modifications to the embodiments described above can be made without departing from the scope of the invention, as is intended to be encompassed by the following claims and their legal equivalents.

PARTS LIST

10. integrated printhead
12. ink supply
14. controller
16. nozzle bore
17. passage
18. ink droplet-forming heater
19. ink droplet-steering heater
20*a*. first side of steering heater
20*b*. second side of steering heater
20*c*. heater quadrant
20*d*. heater quadrant
20*e*. heater quadrant
20*f*. heater quadrant
22. contact pad
23. contact pad
25. conductor
30. large volume ink droplet
31. small volume ink droplet
32. small volume ink droplet
40. droplet deflector system
42. printing apparatus
44. plenum
46. deflection force
48. end
50. recircualtion plenum
60. ink guttering structure
70 ink recovery conduit
80. print drum
90. ink recovery reservoir
100. ink return line
110. vacuum conduit
112. negative pressure source
130. sponge or foam

What is claimed is:

1. An apparatus for controlling ink in a continuous ink jet printer in which a continuous stream of ink is emitted from a nozzle bore; said apparatus comprising:

an ink delivery channel;

a source of pressurized ink communicating with the ink delivery channel, said nozzle bore opening into the ink delivery channel to establish a continuous flow of ink in a stream, the nozzle bore defining a nozzle bore perimeter; and a droplet-forming heater which causes the stream to break up into a plurality of droplets at a position spaced from the nozzle bore; and a droplet-steering heater including a plurality of individually, selectively actuated sections associated with less than the entire perimeter of the nozzle bore, whereby actuation of one of the individually selectively actuated sections of the droplet-steering heater produces an asymmetric application of heat to the stream to control direction of the stream.

2. An apparatus as set forth in claim 1, wherein the plurality of heater sections of the droplet-steering heater, in the aggregate, substantially surround the nozzle bore, said heater sections being individually selectively actuated such that the stream direction can be steered in any of a plurality of directions away from the actuated heated sections.

3. Apparatus as set forth in claim 1, wherein the droplet-forming heater is located up stream of the droplet-steering heater.

4. Apparatus as set forth in claim 1, wherein the droplet-forming heater and the droplet-steering heater are located in the same plane with one heater positioned outside of the other heater.

5. An apparatus for controlling ink in a continuous ink jet printer in which a continuous stream of ink is emitted from a nozzle bore; said apparatus comprising:

an ink delivery channel;

a source of pressurized ink communicating with the ink delivery channel, said nozzle bore opening into the ink delivery channel to establish a continuous flow of ink in a stream, the nozzle bore defining a nozzle bore perimeter; and a droplet-forming heater which causes the stream to break up into a plurality of droplets at a position spaced from the nozzle bore; and a droplet-steering heater having at least one selectively-actuated section associated with less than the entire perimeter of the nozzle bore, whereby actuation of the selectively-actuated section of the droplet-steering heater produces an asymmetric application of heat to the stream to control direction of the stream, wherein the droplet-forming heater is located down stream of the droplet-steering heater.

6. A method of correcting droplet placement error in a printhead including a plurality of nozzles aligned in a row comprising:

forming droplets from fluid ejected through a first nozzle using a droplet-forming heater, the droplets traveling in an ejection direction;

determining when the ejection direction is other than in a desired direction; and using a droplet-steering heater to change the ejection direction of the droplets to the desired direction by asymmetrically applying heat to the fluid, the droplet-steering heater including a plurality of individually, selectively actuated sections, wherein using the droplet-steering heater includes actuating one of the individually selectively actuated sections of the droplet-steering heater to produce the asymmetric application of heat to the fluid.

7. The method according to claim 6, wherein the droplet forming step includes causing the droplets to selectively have either a first volume or a second volume different from the first volume, the method further comprising:

causing the droplets having the first volume to diverge from the droplets having the second volume.

8. The method according to claim 6, wherein the velocity of the corrected jets is kept the same as the velocity of the non-corrected jets by adjusting the total amount of energy applied to the droplet-forming heater and the droplet-steering heater.

9. The method according to claim 6, wherein the velocity of the corrected jets is kept the same as the velocity of the non-corrected jets by reducing the amount of energy applied to the droplet-forming heater by an amount substantially equal to the energy applied to the droplet-steering heater.

10. A printhead comprising:

a droplet-forming heater operable in a first state to form droplets from a fluid stream having a first volume traveling along a path direction and in a second state to form droplets from the fluid stream having a second volume traveling along the path direction;

a droplet deflector system positioned relative to the droplet-forming heater which applies a force to the droplets traveling along the path direction, the force being applied such that the droplets having the first volume diverge from the path direction by a greater extent than do the droplets having the second volume; and a droplet-steering heater adapted to selectively asymmetrically apply heat to the stream such that the path direction is changed.

11. The printhead as set forth in claim 10, wherein the droplet-steering heater is a split heater.

12. Apparatus as set forth in claim 10, wherein the droplet-forming heater is located up stream of the droplet-steering heater.

13. Apparatus as set forth in claim 10, wherein the droplet-forming heater and the droplet-steering heater are located in the same plane with one heater positioned outside of the other heater.

14. A printhead comprising:

a droplet-forming heater operable in a first state to form droplets from a fluid stream having a first volume traveling along a path direction and in a second state to form droplets from the fluid stream having a second volume traveling along the path direction;

a droplet deflector system positioned relative to the droplet-forming heater which applies a force to the droplets traveling along the path direction, the force being applied such that the droplets having the first volume diverge from the path direction by a greater extent than do the droplets having the second volume; and a droplet-steering heater adapted to selectively asymmetrically apply heat to the stream such that the path direction is changed, wherein the droplet-forming heater is located down stream of the droplet-steering heater.

15. A method of printing an image having corrected ink droplet placement comprising:

using a droplet-forming heater to form droplets having a first volume traveling along a path direction and droplets having a second volume traveling along the path direction;

applying a force to the droplets traveling along the path direction such that the droplets having the first volume diverge from the path direction by a greater extent than do the droplets having the second volume; and using a droplet-steering heater to selectively asymmetrically apply heat to the stream such that the path direction is changed.

16. A printhead comprising:

a nozzle bore, the nozzle bore defining a nozzle bore perimeter;

a fluid delivery channel;

a source of pressurized fluid in communication with the nozzle bore through the delivery channel, the fluid being under pressure sufficient to establish a continuous flow of fluid in a stream from the nozzle bore;

a droplet forming heater which causes the stream to break up into a plurality of droplets at a position spaced from the nozzle bore, the droplet forming heater being associated with the nozzle bore; and a droplet steering heater including a selectively-actuated section associated with less than the entire perimeter of the nozzle bore, whereby actuation of the selectively-actuated section of the droplet-steering heater produces an asymmetric application of heat to the stream to control direction of the stream.

17. The printhead as set forth in claim 16, wherein the droplet steering heater includes a plurality of heater sections that, in the aggregate, substantially surround the nozzle bore, the heater sections being individually selectively actuated such that the stream direction can be steered in any of a plurality of directions away from the actuated heated sections.

18. The printhead as set forth in claim 16, wherein the droplet forming heater is located down stream of the droplet steering heater.

19. The printhead as set forth in claim 16, wherein the droplet forming heater is located up stream of the droplet steering heater.

20. The printhead as set forth in claim 16, wherein the droplet forming heater and the droplet steering heater are located in the same plane with one heater positioned outside of the other heater.

* * * * *